US012012263B2

(12) United States Patent
Liu

(10) Patent No.: US 12,012,263 B2
(45) Date of Patent: Jun. 18, 2024

(54) WINE STOPPER

(71) Applicant: Danping Liu, Shenzhen (CN)

(72) Inventor: Danping Liu, Shenzhen (CN)

( * ) Notice: Subject to any disclaimer, the term of this patent is extended or adjusted under 35 U.S.C. 154(b) by 195 days.

(21) Appl. No.: 17/620,689

(22) PCT Filed: Jun. 20, 2019

(86) PCT No.: PCT/CN2019/092110
§ 371 (c)(1),
(2) Date: Dec. 18, 2021

(87) PCT Pub. No.: WO2020/252747
PCT Pub. Date: Dec. 24, 2020

(65) Prior Publication Data

US 2022/0242630 A1 Aug. 4, 2022

(51) Int. Cl.

| | |
|---|---|
| ***G08B 21/00*** | (2006.01) |
| ***B65B 31/06*** | (2006.01) |
| ***B65D 39/00*** | (2006.01) |
| ***B65D 51/16*** | (2006.01) |
| ***B65D 81/20*** | (2006.01) |
| *B65D 85/72* | (2006.01) |

(52) U.S. Cl.
CPC ..... *B65D 51/1683* (2013.01); *B65B 31/06* (2013.01); *B65D 39/0052* (2013.01); *B65D 81/2038* (2013.01); *B65D 85/72* (2013.01)

(58) Field of Classification Search
CPC ..... B65D 51/1683; B65D 39/0052; B65D 81/2038; B65D 85/72; B65D 39/16; B65B 31/06
USPC ..... 340/644
See application file for complete search history.

(56) References Cited

U.S. PATENT DOCUMENTS

| | | | | |
|---|---|---|---|---|
| 7,743,796 | B1 * | 6/2010 | Schooley | G01K 1/14 141/381 |
| 2008/0142470 | A1 * | 6/2008 | van der Lande | B65B 31/047 215/228 |
| 2011/0126939 | A1 * | 6/2011 | Luis | B65B 31/047 141/98 |

FOREIGN PATENT DOCUMENTS

| | | | |
|---|---|---|---|
| CN | 201169431 | Y | 12/2008 |
| CN | 202022425 | U | 11/2011 |
| CN | 202295656 | U | 7/2012 |
| CN | 103350819 | A | 10/2013 |
| CN | 203372565 | U | 1/2014 |
| CN | 203381918 | U | 1/2014 |
| CN | 105857878 | A | 8/2016 |
| CN | 206107930 | U | 4/2017 |
| CN | 206231817 | U | 6/2017 |
| CN | 207566109 | U | 7/2018 |

(Continued)

*Primary Examiner* — Tai T Nguyen
(74) *Attorney, Agent, or Firm* — Cheng-Ju Chiang

(57) ABSTRACT

Provided is a wine stopper capable of being vacuumized, the wine stopper comprising a base capable of covering an outer side of a wine bottle, and a shell enclosing a cavity with the base. A boss capable of being clamped in a bottle opening is arranged on one side, away from the shell, of the base. The wine stopper further comprises a power source arranged in the cavity and a vacuum pump capable of creating a vacuum in the wine bottle, a through hole capable of communicating the vacuum pump with the interior of the bottle is provided in the boss, a measurement assembly capable of measuring a vacuum degree of the interior of the wine bottle is arranged in the cavity, and the measurement assembly is electrically connected with the vacuum pump.

12 Claims, 1 Drawing Sheet

(56) References Cited

FOREIGN PATENT DOCUMENTS

| | | | | |
|---|---|---|---|---|
| CN | 108386337 | A | 8/2018 | |
| CN | 108569476 | A | 9/2018 | |
| CN | 109051272 | A | 12/2018 | |
| CN | 211033585 | U | 7/2020 | |
| DE | 10144922 | A1 * | 4/2003 | ..... B65D 51/248 |
| FR | 2982951 | A1 * | 5/2013 | ..... G01M 3/2869 |
| JP | 2015-81145 | A | 4/2015 | |

* cited by examiner

WINE STOPPER

CROSS REFERENCE TO RELATED APPLICATIONS

The present application is a 35 U.S.C. § 371 National Phase conversion of International (PCT) Patent Application No. PCT/CN2019/092110, filed on Jun. 20, 2019, the disclosure of which is incorporated by reference herein. The PCT International Patent Application was filed and published in Chinese.

FIELD OF THE INVENTION

The present invention relates to a wine stopper capable of vacuuming.

BACKGROUND OF THE INVENTION

Wine stoppers are mostly wooden corks. When people drink wine, they often can't finish a whole bottle. When wine is exposed to air, it will be oxidized, which makes the taste of the wine worse. So there is a problem with the preservation of the remaining wine. The existing preservation method only presses the original cork back to the bottle opening, although it is difficult for outside air to enter the wine bottle in a short time, the air in the bottle cannot be discharged after sealing, which still affects the taste and quality of the wine.

TECHNICAL PROBLEM

The embodiment of the present invention relates to a wine stopper capable of vacuuming, which can at least solve part of the defects of the prior art.

TECHNICAL SOLUTION

The embodiment of the present invention relates to a wine stopper capable of vacuumizing, comprising a base capable of covering an outside of a wine bottle, and a shell enclosing a chamber with the base; a boss capable of being clamped in a bottle opening is arranged at one side of the base away from the shell; the wine stopper further comprises a power source arranged in the chamber and a vacuum pump for vacuuming the wine bottle; a through hole is defined in the boss for communicating the vacuum pump with an interior of the wine bottle; a measurement assembly for detecting a vacuum degree of the interior of the wine bottle is set in the chamber, and the measurement assembly is electrically connected with the vacuum pump.

Wherein, the measurement assembly comprises a silicone plate installed on the base and a first micro-touch switch that controls connection or disconnection of the control circuit of the vacuum pump; both the silicone plate and the first micro-touch switches are arranged in the chamber; the first micro-touch switch can press against an extension end of the silicone plate; the base defines a cavity therethrough corresponding to the extension end of the first micro-touch switch, the cavity can communicate with the wine bottle; and the silicone plate seals the cavity at one end thereof in the chamber.

Wherein, a second micro-touch switch is set on the base; the second micro-touch switch has a contact that can be engaged with an end of the bottle opening to close the control circuit of the vacuum pump; the second micro-touch switch is electrically connected in series with the measurement assembly.

Wherein, the second micro-touch switch further comprise: a guide post that passes through a channel in the base and can move in the channel relative to the base, and a switch unit that can be pressed against by the guide post to control a connection or disconnection of the control circuit of the vacuum pump; the contact is one end of the guide post which extends into the channel in the base for being engaged with the end of the bottle opening, and an opposite end of the guide post away from the contact can press against the switch unit to close the control circuit of the vacuum pump.

Wherein, an elastic element is set to sleeve on the guide post; the elastic element is in the chamber and sandwiched between the switch unit and a flange of the guide post; the flange forms on the end of the guide post with the contact.

Wherein, the through hole of the boss forms a tapered port in an end thereof away from the shell in communication with the wine bottle; and a sealing plug is provided in the tapered port for closing or opening the tapered port; when the vacuum pump stops, the sealing plug is used for closing the tapered port to seal the wine bottle, while the sealing plug is drawn to move up in the through hole when the vacuum pump works, so as to open the tapered port for vacuuming the wine bottle through the through hole.

Wherein, the wine stopper further comprises an anti-tilt switch connected in series to the control circuit of the vacuum pump; the anti-tilt switch is used for detecting a tilt angle of the wine bottle with the wine stopper; if the wine bottle with the wine stopper is tilted to a predetermined tilt angle, the vacuum pump of the wine stopper will be controlled to stop.

Wherein, a silicone sleeve is set to cover on the boss, and is capable of sealing the bottle opening when the boss is inserted in bottle opening.

Wherein, the wine stopper further comprises an indicator light that indicates whether the vacuum pump is working, and the indicator light is electrically connected to the vacuum pump.

Wherein, a light guide post is set at a side of the shell, and the indicator light is arranged in the chamber corresponding to the light guide post.

ADVANTAGES

The wine stopper provided in the present invention, has a vacuum pump arranged in the chamber enclosed by the base and the shell. Air in the wine bottle can be drawn out by means of the vacuum pump to ensure a relative vacuum in the wine bottle; and a measurement assembly is provided in the chamber, and can detect a vacuum degree in the wine bottle. For example, when the measurement assembly detects that the vacuum degree in the wine bottle does not meet the requirements, the vacuum pump start to work to extract air in the wine bottle connected to the base, and when the vacuum degree meets the requirements, the vacuum pump stops. The whole process is performed automatically by the wine stopper, which is more convenient and can always guarantee the quality of the wine in the wine bottle.

BRIEF DESCRIPTION OF THE DRAWINGS

In order to more clearly describe the technical solutions of the embodiments of the present invention, the following will briefly introduce the drawings that need to be used in the description of the embodiments. Obviously, the drawings in the following description are only used in some embodiments of the present invention. For those of ordinary skill in the art, other drawings can be obtained based on these drawings without creative work.

DETAILED DESCRIPTION OF THE INVENTION

The technical solutions in the embodiments of the present invention will be clearly and completely described below in conjunction with the drawings in the embodiments of the present invention. Obviously, the described embodiments are only a part of the embodiments of the present invention, rather than all the embodiments. Based on the embodiments in this invention, all other embodiments obtained by those of ordinary skill in the art without creative work shall fall within the protection scope of the present invention.

Figure 1:
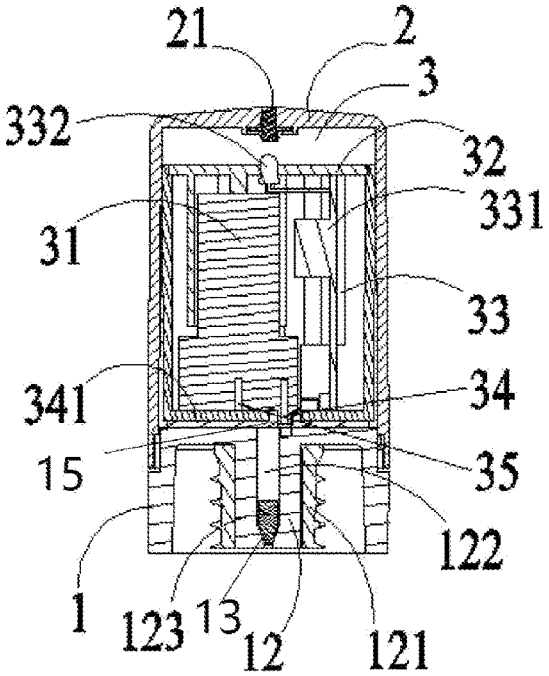
FIG. 1 is a cross-sectional view of a wine stopper capable of vacuumizing in accordance with an embodiment of the present invention.

Referring to FIG. 1, a wine stopper capable of vacuumizing in accordance with an embodiment of the present invention, comprises a base 1 and a shell 2. The base 1 can cover an outside of the wine bottle opening, and the shell 2 is mounted on the base 1 and encloses with the base 1 to form a chamber 3 therebetween. The shell 2 and the base 1 can be connected by means of a snap connection; specifically, a buckle 11 is formed on an outer circular surface of the base 1, and a top section of the base 1 with of the buckle 11 is fitted in the shell 2 with the buckle 11 engaged into a slot of the shell 2 to form a detachable connection between the base 1 and the shell 2. A boss 12 is provided at a side of the base 1 away from the shell 2. When the base 1 is placed on a wine bottle, the boss 12 of the base 1 can extend into the bottle opening and tightly fit with an inner wall of the bottle opening. The boss 12 can be covered with a silicone sleeve 121 adapted to the bottle opening, and an outer surface of the silicone sleeve 121 is provided with threads, thereby, when the boss 12 is inserted into the bottle opening, the silicone sleeve 121 is squeezed and deformed to seal the bottle opening. The wine stopper also comprises a power supply and a vacuum pump 31. The power supply and the vacuum pump 31 are both set in the chamber 3. A battery box 32 is also set in the chamber 3, the vacuum pump 31 is mounted in the battery box 32, and the battery box 32 has two battery cavities for installing batteries, the power supply can be two AAA batteries, and the two batteries are respectively received in the two battery cavities. The opposite ends of the battery box 32 are provided with battery springs 321 and a battery shrapnel 322, respectively. There are two battery springs 321 respectively corresponding to the two mounting holes; and there is one battery shrapnel 321 with two electrodes thereon respectively corresponding to two battery cavities. The battery box 32 is also provided with a control circuit board 33 therein. A control circuit of the vacuum pump 31 is set on the control circuit board 33. The vacuum pump 31 and the power supply are electrically connected to the control circuit. The boss 12 defines a through hole 122 therein. when the boss 12 of the stopper is inserted into the bottle opening, the through hole 122 is in communication with the wine bottle, and the vacuum pump 31 can draw the air in the wine bottle through the through hole 122 and control a vacuum degree in the wine bottle. A measurement assembly 34 is provided in the chamber 3, and the measurement assembly 34 is electrically connected to the vacuum pump 31 through the control circuit. The measurement assembly 34 can be used for detecting a vacuum degree in the wine bottle, thereby achieving the purpose of controlling the operation of the vacuum pump 31. In the present invention, the wine stopper has a function of vacuuming. When the wine stopper is applied to a wine bottle, a vacuum degree in the wine bottle can be detected by the measurement assembly 34, and if the vacuum degree in the wine bottle reaches a preset vacuum degree, the vacuum pump 31 does not work, and if it is detected that the vacuum degree in the bottle does not reach a preset vacuum degree, the vacuum pump 31 starts to extract air in the wine bottle until the vacuum degree reaches the preset vacuum degree. The whole process is completed automatically, which is more convenient, especially when there is remaining wine in the wine bottle after the wine bottle is opened, the vacuum degree in the wine bottle can be automatically controlled through this wine stopper to ensure the taste of the remaining wine. Generally, the through hole 122 forms a tapered port (tapered hole) 13 in an end thereof in communication with the wine bottle, and a sealing plug is provided in the tapered port 13. The sealing plug can be a sealing silicone plug 123. When the vacuum degree in the wine bottle reaches a preset vacuum degree, the wine stopper stops vacuuming, and then the sealing silicone plug 123 can be used for sealing the wine bottle and maintain a vacuum degree in the wine bottle. Since the wine bottle is in a relative vacuum state, there will always be a suction force to keep the sealing silicone plug 123 sucked and fitted in the tapered hole 13 of the base 1 with a good sealing. The sealing plug 123 can be drawn to move up in the through hole 122 when the vacuum pump 31 works so as to open the tapered port 13 for vacuuming the wine bottle through the through hole 122.

Figure 2:
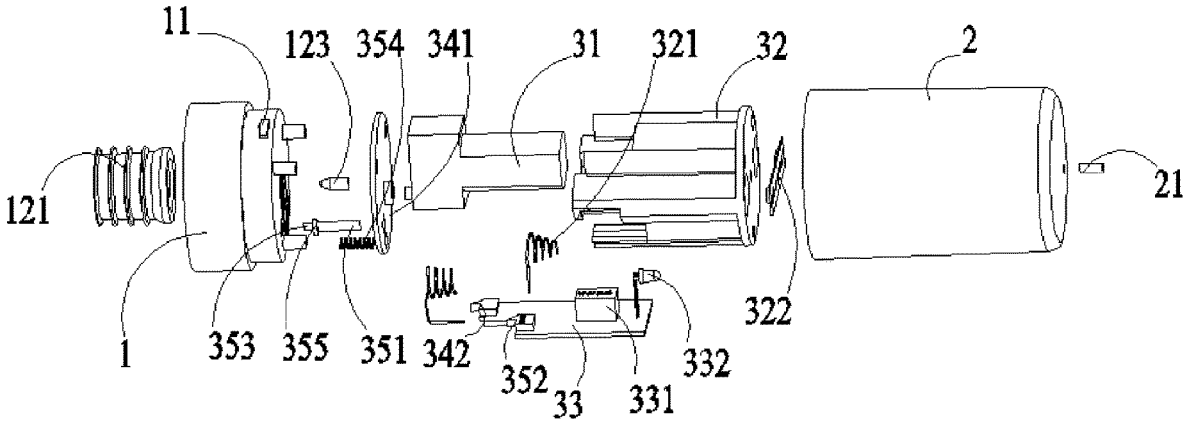
FIG. 2 is an exploded view of the wine stopper capable of vacuumizing of FIG. 1.

Referring to FIGS. 1 and 2, specifically, the measurement assembly 34 comprises a silicone plate 341 installed on the base 1 and a first micro-touch switch 342 that controls the on-off of the control circuit of the vacuum pump. The silicone plate 341 and the first micro-touch switches 342 are all set in the chamber 3, and the first micro-touch switch 342 is set on the control circuit board 33, and can presses against the silicone plate 341. The base 1 defines a cavity 15 therethrough corresponding to an extension end of the first micro-touch switch 342, and the cavity 15 can communicate with the wine bottle. The silicone plate 341 can seal the cavity 15 at one end thereof towards the chamber 3. In this embodiment, the measurement assembly 34 uses a micro-touch switch to control the on-off of the control circuit of the vacuum pump 31. The silicone plate 341 has one side corresponding to the wine bottle, and the other opposite side corresponding to the chamber 3. When the plate 341 is pressed against the first micro-touch switch 342, the control circuit becomes connected, thus the vacuum pump 31 start to work to extract air in the wine bottle through the through hole 122 of the base 1. During the vacuuming process, an air pressure in the wine bottle gradually decreases, that is, an air pressure onto the side of the silicone plate 341 corresponding to the wine bottle gradually decreases, while an air pressure onto the other opposite side of the silicone plate 341 corresponding to the chamber 3 remains unchanged, so that the silicone plate 341 is gradually deformed and recessed into the cavity 15 of the base 1, and releases the first micro-touch switch 342 under the air pressure onto the side of the silicone plate 341 corresponding to the chamber 3, and a pressing force of the silicone plate 341 on the first micro-touch switch 342 is gradually reduced. When the pressing force of the silicone plate 341 on the first micro-touch switch 342 is reduced to a certain degree or disappears, the first micro-touch switch 342 open the control circuit of the vacuum pump 31, the vacuum pump 31 stops working, and at this time, a vacuum degree in the wine bottle has reached a predetermined vacuum degree.

In another embodiment, a second micro-touch switch 35 is also mounted to the base 1, and is set on the control circuit board 33. The second micro-touch switch 35 has a contact 353 which can also control the on-off of the control circuit of the vacuum pump. The second micro-touch switch 35 is electrically connected in series with the first micro-touch switch 342 of the measurement assembly 34. When the wine stopper is engaged with the wine bottle, an end of the bottle opening can press against the contact 353, which make the control circuit connected by means of the contact 353. In this embodiment, the second micro-touch switch 35 and the first micro-touch switch 342 must be closed at the same time to keep the control circuit connected, and one of which is open will make the control circuit disconnected. When the boss 12 of the base 1 is inserted in the bottle opening, an end of the bottle opening is engaged with the contact 353 which makes the second micro-touch switch 35 closed; and the air pressure in the wine bottle is the same as the outside air pressure at this time, which make the first micro-touch switch 342 to maintain a closed state, thereby the vacuum pump 31 starts to work.

For optimizing the above embodiment, the second micro-touch switch 35 comprises a guide post 351 and a switch unit 352. The guide post 351 passes through a channel in the base 1 and can move therein relative to the base 1, and the guide post 351 can press against or release the switch unit 352 to control the connection or disconnection of the control circuit of the vacuum pump 31. The switch unit 352 is set on the control circuit board 33, and the contact 353 is one end of the guide post 351 which extends into the channel in the base 1, and the other end of the guide post 351 opposite to the contact 353 can press against the switch unit 352. In this embodiment, an end of the bottle opening can push against the guide post 351 to move linearly, and then the guide post 351 pushes against the switch unit 352, and at this time, the switch unit 352 is in the closed state. When the wine stopper is taken away from the wine bottle, the guide post 351 will fall back to the channel in the base 1 and the switch unit 352 will be disconnected; at this time, even if the measurement assembly 34 detects that an air pressure in the wine bottle is higher, the vacuum pump 31 will not work, which can prevent the vacuum pump 31 from malfunctioning. Further, an elastic member 354 can be set to sleeve on the guide post 351, and the guide post 351 is provided with a flange 355 on one end thereof with the contact 353. The elastic member 354 is arranged in the chamber 3, and is set between the switch unit 352 and the flanges 355, The elastic member 354 is usually a return spring. When the guide post 351 pushes against the switch unit 352, the return spring is compressed. When the wine stopper is installed to the wine bottle, the return spring is compressed; if the wine stopper is pulled out from the wine bottle, the return spring pushes the flange 355, and then drives the guide post 351 to move into the channel in the base 1, and the switch assembly is disconnected.

Referring to FIG. 2, in another embodiment of the present invention, the wine stopper further comprises an anti-tilt switch 331, and the anti-tilt switch 331 is also connected in series to the control circuit of the vacuum pump 31 and is set on the control circuit board 33. The anti-tilt switch 331 can detect a tilt angle of the wine bottle. After the wine stopper is inserted into the bottle opening, if the wine bottle is tilted to a certain angle and the wine stopper continues to vacuum, wine will be drawn out from the wine bottle, which will cause damage to the wine stopper. To avoid the wine stopper from vacuuming at the above possible situations, set a predetermined tilt angle, if the wine bottle with the wine stopper is tilted to the predetermined tilt angle, the wine stopper will automatically stop vacuuming, and the predetermined tilt angle can be less than 20 degrees or less than 45 degrees.

Further, the wine stopper also comprises an indicator light 332, which can be an LED indicator 332. The indicator light 332 is electrically connected to the vacuum pump 31. The indicator light 332 is used to indicating whether the vacuum pump 31 is working. For example, when the vacuum pump 31 is working, the indicator light 332 is blue, and when the vacuum pump 31 stops working, the indicator light 332 is green. A light guide post 21 is mounted at a side of the shell 2 away from the base 1. The indicator light 332 is set in the chamber 3 corresponding to the light guide post 21. The indicator light 332 is also set on the control circuit board 33, and the light emitted by the indicator light 332 can be transmitted through the light guide post 21 to for the user to observe, and the indicator light 332 is set inside the shell 2 for protection. In another embodiment, the indicator light 332 is also set in the shell 2, and the shell 2 is light-transmitting. The light-transmitting shell can be made of a transparent or translucent material. Perform electroplating or spraying rubber oil or ordinary oil to treat a surface of the shell 2; and then, engrave with laser on the surface of the shell 2 where corresponds to the indicator light 332, generally at the middle position on the top surface of the shell 2, to form a laser mark indicating the work of the vacuum pump 31. The laser mark can be a pattern or a LOGO. When the LED indicator 332 is illuminated, the surface of the shell 2 will display the laser mark which also acts as a light indicator to indicate that the vacuum pump is working, so as to achieve the same technical effect as the previous embodiment.

The above are only the preferred embodiments of the present invention, and are not intended to limit the present invention. Any modification, equivalent replacement, improvement, etc. made within the spirit and principle of the present invention shall be included in the present invention. Within the scope of protection.

What is claimed is:

1. A wine stopper, comprising:

a base used for engaging with a bottle opening of a wine bottle;

a shell housing the base and enclosing a chamber therein with the base; and a control circuit board, a measurement assembly, a power source and a vacuum pump for vacuuming the wine bottle, which are all set in the chamber;

wherein, a boss used for being clamped in the bottle opening is set on one side of the base away from the shell; the boss defines a through hole communicating the vacuum pump with the wine bottle; a control circuit of the vacuum pump is set on the control circuit board; the measurement assembly is used for detecting a vacuum degree in the wine bottle, and the power source and the measurement assembly are electrically connected with the control circuit of the vacuum pump; the measurement assembly comprises a silicone plate installed on the base and a first micro-touch switch that controls connection or disconnection of the control circuit of the vacuum pump; both the silicone plate and the first micro-touch switches are arranged in the chamber; the first micro-touch switch can press against an extension end of the silicone plate; the base defines a cavity therethrough corresponding to an extension end of the first micro-touch switch, the cavity can communicate with the wine bottle; and the silicone plate seals the cavity at one end thereof in the chamber.

2. The wine stopper of claim 1, wherein a second micro-touch switch is set on the base; the second micro-touch switch has a contact that can be engaged with an end of the bottle opening to close the control circuit of the vacuum pump; the second micro-touch switch is electrically connected in series with the measurement assembly.

3. The wine stopper of claim 2, wherein the second micro-touch switch further comprise:

a guide post that passes through a channel in the base and can move in the channel relative to the base, and a switch unit that can be pressed against by the guide post to control a connection or disconnection of the control circuit of the vacuum pump; the contact is one end of the guide post which extends into the channel in the base for being engaged with the end of the bottle opening, and an opposite end of the guide post away from the contact can press against the switch unit to close the control circuit of the vacuum pump.

4. The wine stopper of claim 3, wherein an elastic element is set to sleeve on the guide post; the elastic element is in the chamber and sandwiched between the switch unit and a flange of the guide post; the flange forms on the end of the guide post with the contact.

5. The wine stopper of claim 4, wherein the guide post is used for pressing against the switch unit to close the control circuit of the vacuum pump due to the end of the bottle opening pushing against the guide post to move up; and the guide post releases the switch unit to open the control circuit of the vacuum pump when the guide post falls back to the channel in the base due to the wine stopper separated from the wine bottle.

6. The wine stopper of claim 5, wherein the elastic member is a spring sleeved on the guide post; the spring is compressed when the guide post moves up to press against the switch unit, and an elastic force of the spring pushes the flange to drive the guide post to fall into the channel in the base when the wine stopper separated from the wine bottle.

7. The wine stopper of claim 1, wherein the through hole of the boss forms a tapered port in an end thereof away from the shell in communication with the wine bottle; and a sealing plug is provided in the tapered port for closing or opening the tapered port; when the vacuum pump stops, the sealing plug is used for closing the tapered port to seal the wine bottle, while the sealing plug is drawn to move up in the through hole when the vacuum pump works, so as to open the tapered port for vacuuming the wine bottle through the through hole.

8. The wine stopper of claim 1, further comprising an anti-tilt switch connected in series to the control circuit of the vacuum pump; the anti-tilt switch is used for detecting a tilt angle of the wine bottle with the wine stopper; if the wine bottle with the wine stopper is tilted to a predetermined tilt angle, the vacuum pump of the wine stopper will be controlled to stop.

9. The wine stopper of claim 1, wherein a silicone sleeve is set to cover the boss, and is used for sealing the bottle opening when the boss is inserted in bottle opening.

10. The wine stopper of claim 1, further comprising an indicator light that indicates whether the vacuum pump is working, and the indicator light is electrically connected to the vacuum pump.

11. A wine stopper, comprising:

a base used for engaging with a bottle opening of a wine bottle;

a shell housing the base and enclosing a chamber therein with the base;

a control circuit board, a measurement assembly, a power source and a vacuum pump for vacuuming the wine bottle, which are all set in the chamber; and an indicator light that indicates whether the vacuum pump is working, and the indicator light is electrically connected to the vacuum pump;

wherein, a boss used for being clamped in the bottle opening is set on one side of the base away from the shell; the boss defines a through hole communicating the vacuum pump with the wine bottle; a control circuit of the vacuum pump is set on the control circuit board; the measurement assembly is used for detecting a vacuum degree in the wine bottle, and the power source and the measurement assembly are electrically connected with the control circuit of the vacuum pump; wherein a light guide post is set at a side of the shell, and the indicator light is arranged in the chamber corresponding to the light guide post.

12. The wine stopper of claim 10, wherein the indicator light is in the chamber, the shell is light-transmitting, and a laser mark is set on the light-transmitting shell corresponding to the indicator light.

* * * * *